United States Patent [19]

Ritter

[11] Patent Number: 4,893,355

[45] Date of Patent: Jan. 16, 1990

[54] KNEE PROTECTOR

[76] Inventor: William H. Ritter, 3644 Southern Blvd., Birmingham, Ala. 35242

[21] Appl. No.: 229,273

[22] Filed: Aug. 8, 1988

[51] Int. Cl.[4] ..... A41D 13/00

[52] U.S. Cl. ..... 2/24; 2/16

[58] Field of Search ..... 2/22, 23, 24, 62, 16; 128/80 C

[56] References Cited

U.S. PATENT DOCUMENTS

| | | | |
|---|---|---|---|
| 1,862,303 | 6/1932 | Glahe | 2/24 |
| 3,465,365 | 9/1969 | Jones et al. | 2/24 |
| 3,742,517 | 7/1973 | Bednarczuk et al. | 2/22 |
| 4,250,578 | 2/1981 | Barlow | 2/24 |

*Primary Examiner*—Ronald Feldbaum
*Attorney, Agent, or Firm*—James B. Middleton

[57] ABSTRACT

A knee protector covers the front of the knee, and extends rearwardly on both sides to protect against mechanical damage to the knee. The protector has foamed padding towards the leg for both comfort and mechanical protection, and a somewhat rigid outer shell to provide strength. For comfort as the leg is flexed, the front of the knee protector has a line about which the rigid shell can move, so that two sections of the shell are articulated, allowing movement in all directions. One side of the knee protector can be shortened to allow the use of a knee splint in conjunction with the knee protector.

5 Claims, 1 Drawing Sheet

Fig_1
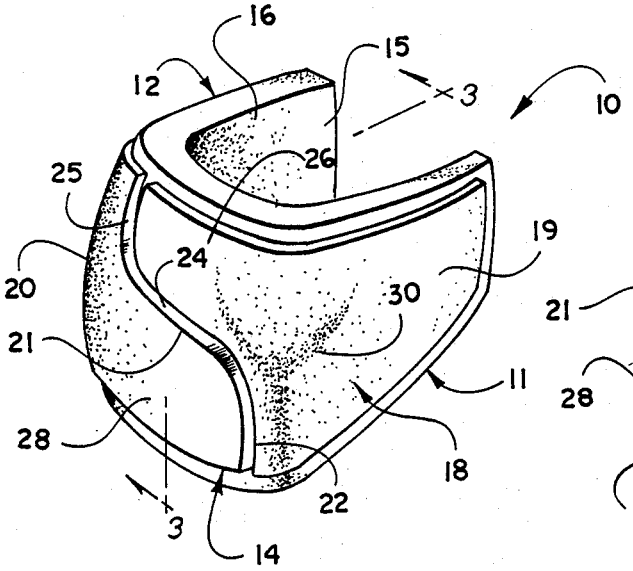
Fig_3
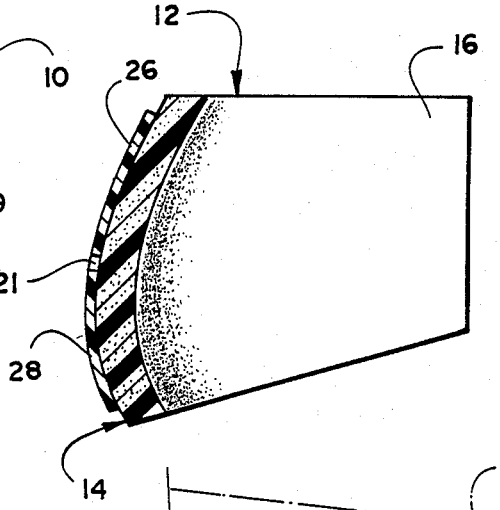
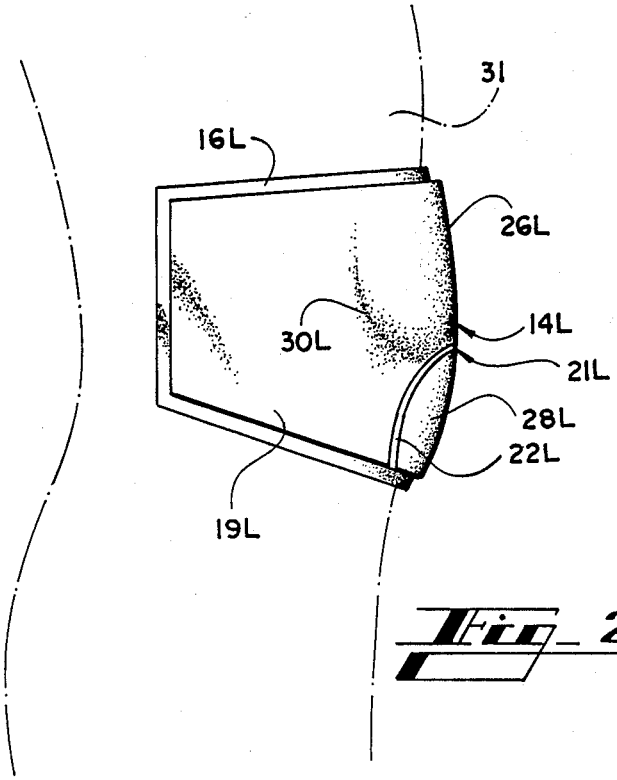
Fig_2
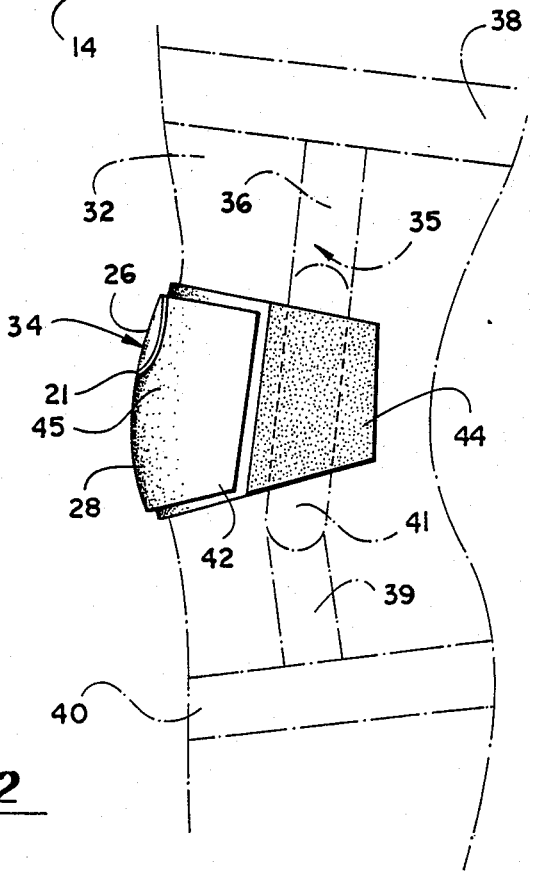
Fig_4

KNEE PROTECTOR

INFORMATION DISCLOSURE STATEMENT

In many active sports there is a possibility that a player will receive a sufficient blow on the knee to cause some considerable damage. Though this fact is well known, many players decline to wear certain knee guards or protectors because the knee guards so restrict motion that the player is unable to perform at his best level. There are many supports, guards and the like that are designed for protection of the knee joint, but these amount to no more than an elastic sleeve, frequently with some padding. It will be readily understood that such a device is incapable of protecting the person's knee against a severe blow.

There have been some knee guards that attempt to provide a rigid member for true protection of the joint. For example, U.S. Pat. No. 3,712,299 to Voehl discloses a device that is largely padding, but includes one rigid member generally centrally of the knee joint. Obviously, the rigid device will protect the knee joint only in the very narrow area covered by the rigid device. Another knee protector is shown in U.S. Pat. No. 3,742,517 issued to Bednarczuk et al. The Bednarczuk et al. patent discloses a generally rigid, though somewhat elastic, cage for the knee, and including a covering for the knee cap. While this device may in fact provide some protection, it will be seen that either the device must be quite large to provide needed comfort during the various contortions of the knee, or the device will be extremely uncomfortable as the knee is contorted during flexions of the leg. Large size obviously militates against the desired protection.

SUMMARY OF THE INVENTION

This invention relates generally to protective equipment, and is more particularly concerned with a knee protector having the strength to prevent damage to the knee while allowing sufficient flexibility for comfort.

The present invention provides a knee protector having side portions extending on both sides of the leg, and a front portion covering the front of the knee and the knee cap. The side portions and the front portions include padding for comfort, and include a rigid outer surface for providing protection to the knee. The front portion of the knee protector has an articulated joint for allowing relative motion between sections of the knee protector. In the preferred embodiment of the invention, the articulated joint is provided by separating the two sections of the rigid outer surface of the knee protector, the two sections being adhered to the padding so that the padding serves to maintain the integrity of the knee protector.

The knee protector of the present invention can have one or both sides extend over any desired portion of the side of the knee, so the protector of the present invention may be worn in conjunction with other support means.

BRIEF DESCRIPTION OF THE DRAWINGS

These and other features and advantages of the present invention will become apparent from consideration of the following specification when taken in conjunction with the accompanying drawings in which:

FIG. 1 is a perspective view showing a knee protector made in accordance with the present invention, the knee protector being adapted for use on the right leg of a wearer;

FIG. 2 is a side elevational view of a knee protector substantially like the embodiment shown in FIG. 1, FIG. 2 showing a knee protector for the left leg;

FIG. 3 is a cross-sectional view taken substantially along the line 3—3 in FIG. 1; and, FIG. 4 is a side elevational view of a modified form of knee protector, a portion of a leg being shown in phantom.

DETAILED DESCRIPTION OF THE EMBODIMENTS

Referring now more particularly to the drawings, and to those embodiments of the invention here presented by way of illustration, the knee protector is generally indicated at 10 and includes an inside portion 11, an outside portion 12 generally parallel to the inside portion 11, and a front portion 14 connecting the two side portions 11 and 12. It will be understood that the wearer's knee will be received within the opening 15 in the U-shape defined by the sides 11 and 12 and the front 14.

The opening 15 is completely lined by padding material 16, here indicated as a foamed plastic. Outwardly of the padding material 16, there is a rigid protective member 18, the protective member 18 being divided into two sections designated at 19 and 20. These two sections 19 and 20 are separated from each other along a line 21.

From the foregoing general description, it should be apparent that the knee protector 10 will be placed over a person's knee with the inside portion 11 extending along the inside of the knee while the outside portion 12 extends along the outside of the knee. The front portion 14 then covers the front of the knee and including the knee cap. The padding material 16 will be towards the person's leg, while the protective member 18 will be outwardly of the padding 16.

Those skilled in the art will realize that, as a person's leg flexes, the knee joint is subject to considerable motion. This is because the joint between the tibia and the femur is a sliding joint, and the knee cap, or patella, somewhat floats over the area of articulation. Further considering the muscles engaged in causing the flexing of the leg, it will be understood that the knee tends to expand laterally during flexing, in addition to the other motions. As a result, a completely rigid knee protector 18 will be very uncomfortable during flexing of the leg. Alternatively, it will be understood that the knee cap itself is highly subject to damage from mechanical blows, so it is very desirable to have some mechanical protection for the knee cap. The solution to these contradictory demands is in the use of the two sections 19 and 20, the sections being articulated for relative movement.

As is shown in FIG. 1 of the drawings, the section 19 is substantially coextensive with the side portion 11 of the knee protector 10, and extends into the front portion 14. The section 14 is divided from the section 20 by the line of articulation 21. From the line of articulation 21, the section 20 extends around to the side portion 12.

Looking specifically at the line of articulation 21, it will be seen that the line begins adjacent to the inside portion 11, and extends upwardly as at 22. The articulation line then curves to become approximately horizontal in the area designated at 24; and, the articulation line then curves upwardly again into the final portion 25. It will be understood that, along the line of articulation 21, the two sections 19 and 20 are maintained in their positions only by being attached to the padding materials 16. Otherwise, the sections 19 and 20 are separated. Because of this construction, it will be seen that the side portions 11 and 12 can move towards or away from each other, the upper and lower lobes 26 and 28 of the sections 19 and 20 respectively pivoting generally at the corners of the knee protector 10, and extending somewhat outwardly, i.e. away from the knee. Conversely, as the side portions 11 and 12 are moved away from each other, the lobes 26 and 28 will move inwardly, towards the knee. Similarly, it will be understood that the portions 11 and 12 can pivot with respect to each other generally around the section 24 of the line of articulation 21, and can move in almost any combination of these motions. Thus, there is complete freedom for the knee to become distorted in virtually any direction and the knee protector 10 will remain comfortable. While the knee protector 10 will remain comfortable, it will also be noted that the knee will at all times be covered by the protective material 18. Though there is a line of articulation 21 that is covered by only padding material 16, this line of articulation will be quite small, perhaps an eighth inch or so, so that the front of the knee is well protected.

Looking at FIGS. 1, 2 and 3 of the drawings, it will be noted that the knee protector 10 is generally shaped to conform to the area in the vicinity of the wearer's knee. It will be noted that the lower portion of the knee protector 10 is curved inwardly as indicated by the shading at 30. The widest portion of the knee is substantially in the center of the knee transversely, approximately at a horizontal diameter through the knee cap. Below this line, the knee tapers downwardly to the size of the tibia from the enlarged area of contact. Thus, the knee protector 10 generally conforms to the shape of the leg in the vicinity of the knee, and the articulating line 21 provides flexibility necessary for the knee protector 10 to be comfortable as discussed above.

Looking especially at FIG. 2, it will be noted that a leg is shown in phantom at 31 to illustrate the relative location of the knee protector 10. Since the knee protector shown in FIG. 2 is substantially the same as the one shown in FIG. 1, with the exception that the knee protector shown in FIG. 2 is for the left leg rather than the right leg, the knee protector shown in FIG. 2 carries the same reference numerals but with an L suffix. Also, those skilled in the art will undestand that, in sport clothes such as football uniforms, the pants include pockets appropriately located to receive the padding. It is therefore contemplated that the knee protector 10 or 10L will be received within a pocket in pants or the like to hold the knee protector 10 or 10L in place with respect to the leg 31.

The knee protector of the present invention is adapted to protect the knee from injurious blows, primarily from the front, but also somewhat from the sides. It should be recognized, however, that the knee protector of the present invention does not lend the knee joint additional lateral strength. There are other protecting and supporting devices that are designed to provide such lateral strength, and FIG. 4 of the drawings shows a lateral support means in phantom on the leg 32 in conjunction with a slightly modified knee protector 34 made in accordance with the present invention.

Those skilled in the art will understand that braces, or splints, of the type generally indicated at 35 are in use by some athletes. The splint 35 includes generally an upper portion 36 fixed with respect to the leg 32 as at 38. There is a lower splint portion 39 fixed with respect to the lower leg as at 40. Between the upper and lower pieces 36 and 39, there is a hinged length 41, the length 41 being hinged at its upper and lower ends to the upper and lower pieces 36 and 39.

A splint such as the splint 35 will generally be utilized in the position shown in FIG. 4. Because of this position, it will be understood that a complete knee protector as shown in FIG. 1 of the drawings would interfere with the splint 35. In view of the nature of the present invention, it will be understood that the side portion 42 can be terminated short of the side portion 44 to allow adequate room for the splint 35. It will be noted that the articulating line 45 is formed precisely like the articulating line 21 shown in FIG. 1 of the drawings, so the knee protector of the present invention provides all of the features described above, but has one wall foreshortened to allow room for the splint 35.

From the above discussion, those skilled in the art will readily recognize that the knee protector 10 can be made of many different materials. For general use, it has been found that a polyethylene approximately $\frac{1}{8}$ inch thick provides good protection, and the padding 16 can be a foamed thermoplastic elastomeric material about $\frac{3}{8}$ inch thick. One desirable material is EPT/polyethylene/butyl manufactured by Rubatx Corp., Bedford, Va. 24523. Numerous other materials will suggest themselves to those skilled in the art, the criteria being some elasticity in the material so that the knee protector can flex somewhat, in combination with sufficient strength that the material will afford the desired protection to the knee. Some of the acrylic materials, such as a polymethylmethacrylate can be used, perhaps with a filler to reduce the brittleness. Also, an acrylonitrile butadienestyrene, a polycarbonate or numerous other materials could be utilized with appropriate engineering to determine the particular thickness desired. Similarly, various materials can be utilized as the padding material 16, including expanded butyl rubbers, polyurethane, expanded ethylene vinyl acetate and the like.

It will of course be understood by those skilled in the art that the particular embodiments of the invention here presented are by way of illustration only, and are meant to be in no way restrictive; therefore, numerous changes and modifications may be made, and the full use of equivalents resorted to, without departing from the spirit or scope of the invention as outlined in the appended claims.

I claim:

1. A knee protector for shielding a knee against blows, said knee having a kneecap on the front thereof, an inside surface on one side of said knee and an outside surface on the opposite side of said knee, said knee protector comprising padding means consisting of flexible padding material carrying protecting means of generally rigid material, said knee protector further including an inside portion for at least partially covering said inside surface and said knee, and an outside portion generally parallel to said inside portion and spaced therefrom for at least partially covering said outside surface of said knee, and a front portion connecting said inside portion and said outside portion and covering said kneecap, said protecting means defining a line of articulation for providing a first section of said protecting means and a second section of said protecting means, said line of articulation defining on said front portion on upper lobe of said protecting means and a lower lobe of said protecting means, and first section of said protecting means being generally coextensive with said inside portion of said knee protector and integral with one of said lobes of said protecting means, said second section of said protecting means being generally coextensive with said outside portion of said knee protector and integral with the other of said lobes of said protecting means.

2. A knee protector as claimed in claim 1, said line of articulation being defined by a cut in said protecting means, said cut dividing said protecting means into said first section and said second section.

3. A knee protector as claimed in claim 2, said upper lobe being above said line of articulation and said lower lobe being below said line of articulation, said upper lobe being integral with said protecting means on said inside portion of said knee protector, said lower lobe being integral with said protecting means on said outside portion of said knee protector.

4. A knee protector as claimed in claim 3, said line of articulation extending generally horizontally across said front portion, said line of articulation turning down adjacent to said inside portion and turning up adjacent to said outside portion.

5. A knee protector as claimed in claim 1, said outside portion being shorter than said inside portion, and further including a knee splint extending generally longitudinally of the leg of a wearer adjacent to said outside portion.

* * * * *